US008757729B2

(12) United States Patent
Killion

(10) Patent No.: US 8,757,729 B2
(45) Date of Patent: Jun. 24, 2014

(54) AUTOMATIC REAR LEG CONTROL FOR COLD PLANERS

(75) Inventor: Daniel H. Killion, Blaine, MN (US)

(73) Assignee: Caterpillar Paving Proudcts Inc., Minneapolis, MN (US)

( * ) Notice: Subject to any disclaimer, the term of this patent is extended or adjusted under 35 U.S.C. 154(b) by 241 days.

(21) Appl. No.: 13/335,361

(22) Filed: Dec. 22, 2011

(65) Prior Publication Data

US 2013/0162004 A1 Jun. 27, 2013

(51) Int. Cl.
*E01C 23/12* (2006.01)

(52) U.S. Cl.
USPC ..... 299/1.5; 404/84.05

(58) Field of Classification Search
USPC ..... 299/1.5; 404/84.05
See application file for complete search history.

(56) References Cited

U.S. PATENT DOCUMENTS 4,256,344 A * 3/1981 Hatcher ..... 299/39.4
5,309,407 A 5/1994 Sehr et al.
5,768,973 A 6/1998 Cochran
5,799,403 A * 9/1998 Schrum ..... 33/290
5,984,420 A 11/1999 Murray et al.
6,371,566 B1 * 4/2002 Haehn ..... 299/1.5
7,047,735 B2 5/2006 Sprinkle et al.
7,828,309 B2 11/2010 Berning et al.
2008/0298891 A1 * 12/2008 Boucherat et al. ..... 404/1
2009/0108663 A1 * 4/2009 Berning et al. ..... 299/1.5
2010/0109422 A1 5/2010 Busley et al.

FOREIGN PATENT DOCUMENTS

EP 1 154 075 A2 11/2001

* cited by examiner

*Primary Examiner* — John Kreck
(74) *Attorney, Agent, or Firm* — Miller, Matthias & Hull

(57) ABSTRACT

A method of maintaining a machine substantially level with a first surface is disclosed. The method may comprise determining an electronic travel path between a first point and a second point on a second surface, the second surface created by a tool removing a section of the first surface, and adjusting the length of the rear leg to maintain the frame substantially level to the first surface as the rear leg moves along the travel path from the first point to the second point in a forward direction. A machine for planing a road is disclosed that maintains a parallel orientation with the road during operation.

20 Claims, 9 Drawing Sheets

AUTOMATIC REAR LEG CONTROL FOR COLD PLANERS

TECHNICAL FIELD

The present disclosure generally relates to machines for the treatment of roadway surfaces, and more particularly to a road planer for roadway surfacing operations.

BACKGROUND

Road milling machines, also known as cold planers, may be configured to scarify, remove, mix, or reclaim material from the surface of bituminous, concrete, or asphalt roadways and other surfaces using a rotatable planing tool mounted on a frame. The frame may be mounted on a plurality of tracks or wheels which support and transport the machine along the roadway surface.

Typically, cold planers may also include a plurality of lifting members positioned near the front and rear of the frame. The lifting members may be adjusted between extending and retracted positions to control the depth and shape of a cut by raising or lowering the frame and rotatable planning tool.

U.S. Publication No. 2009/0108663 ("Berning et al.") published Apr. 30, 2009 is an example of prior art related to positioning a road milling machine parallel with the ground. While Berning et al. discusses controlling the parallelism of the machine after a change in milling depth, it does not disclose actively managing this parallelism during the descent or ascent to the new milling depth. A better design is needed that actively controls the extension or retraction of the rear legs during the change in milling depth.

SUMMARY OF THE DISCLOSURE

In accordance with one aspect of the disclosure, a method of maintaining a machine substantially level with a first surface is disclosed for a machine including a front leg disposed on the first surface and a rear leg, a frame supported by the front leg and the rear leg, and a tool mounted on the frame between the front and rear legs. The method may comprise determining an electronic travel path between a first point and a second point on a second surface, the second surface created by the tool removing a section of the first surface, and adjusting the length of the rear leg to maintain the frame substantially level to the first surface as the rear leg moves along the travel path from the first point to the second point in a forward direction.

In accordance with another aspect of the disclosure, a method is disclosed for maintaining a cold planer substantially level to a first surface during a planing operation on the first surface. The cold planer may include a front leg having a front leg length and a rear leg having a rear leg length, a frame supported by the front and rear legs, and a rotatable drum mounted on the frame between the front and rear legs. The front leg may be disposed on a first surface having a first grade. The method may comprise determining electronically a travel path between first and second points on a second surface, and between the second point on the second surface and a third point on a third surface, the second point on the second surface at a second grade and the third point on the third surface at a third grade, wherein the first and second grades are different and the first point is disposed directly adjacent to the first surface, and adjusting the rear leg length to maintain the frame substantially level to the first surface as the rear leg moves along the travel path.

In accordance with a further aspect of the disclosure, a machine for planing a road is disclosed. The machine may comprise a frame, a plurality of ground engaging units, a plurality of vertically adjustable legs, each leg connecting one of the plurality of ground engaging units to the frame, and a controller configured to adjust the rear leg length to maintain the frame in a generally parallel orientation to the first surface when the rear leg moves along a travel path. The plurality of legs may include at least one rear leg having a rear leg length and at least one front leg having a front leg length. The front leg may be disposed on a first surface. The travel path may include a first surface having a first grade and a second surface created by removal of a section of the first surface. The second surface may include a portion having a second grade, the first grade different than the second grade.

DETAILED DESCRIPTION

Figure 1:
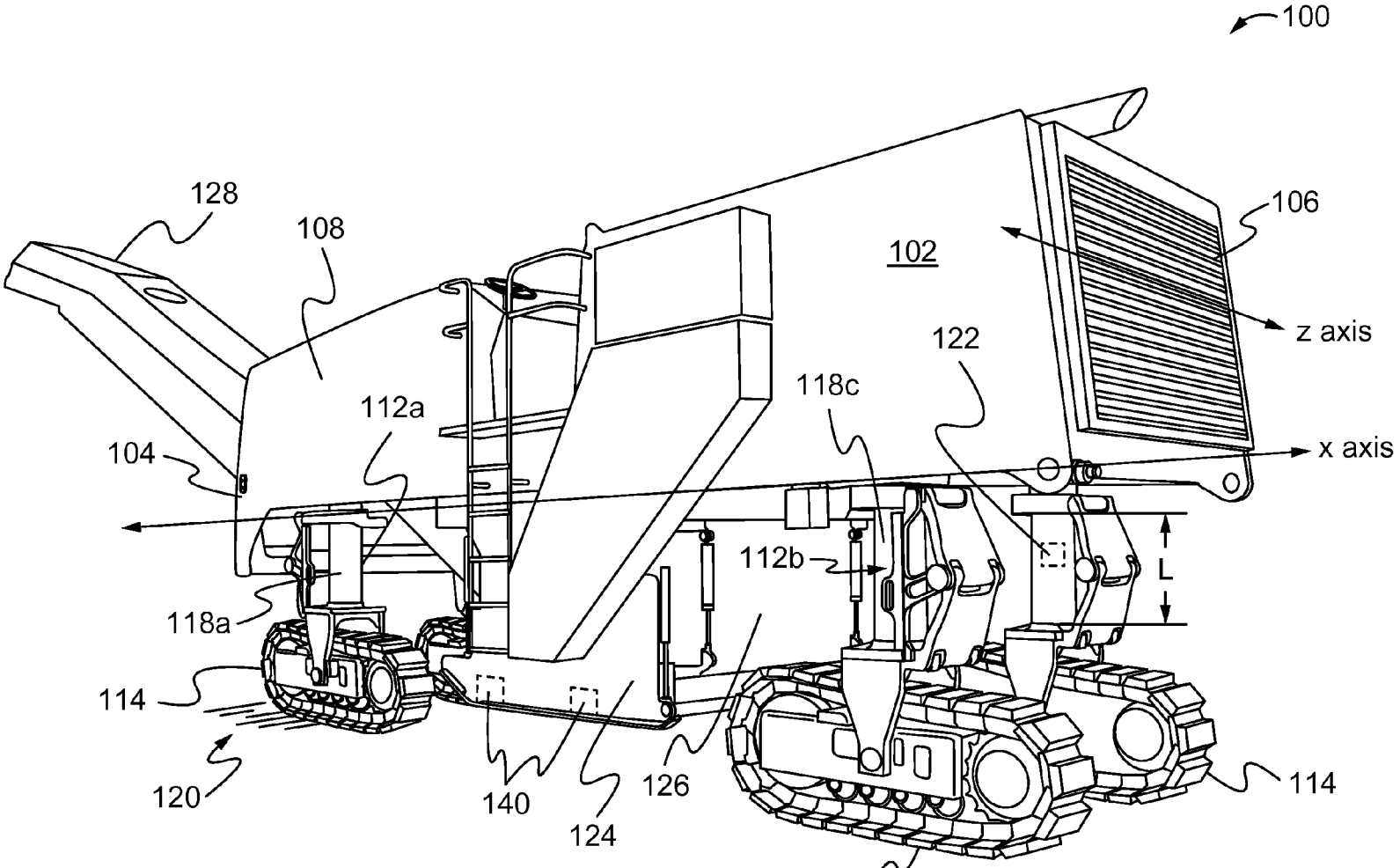
FIG. 1 is a perspective view of an exemplary machine in accordance with the teachings of this disclosure.
Figure 2:
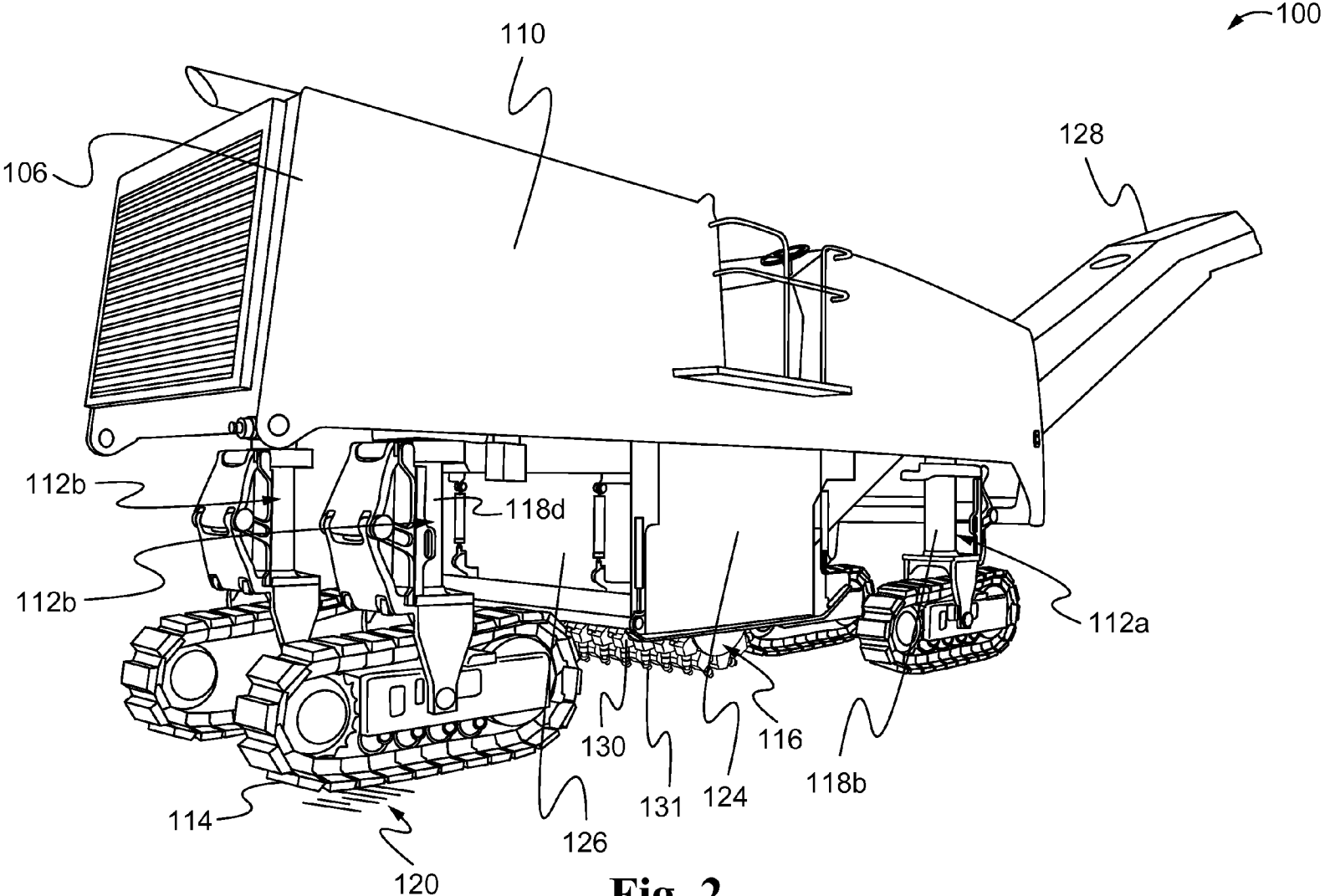
FIG. 2 is another perspective view of the exemplary machine of FIG. 1.
Figure 3:
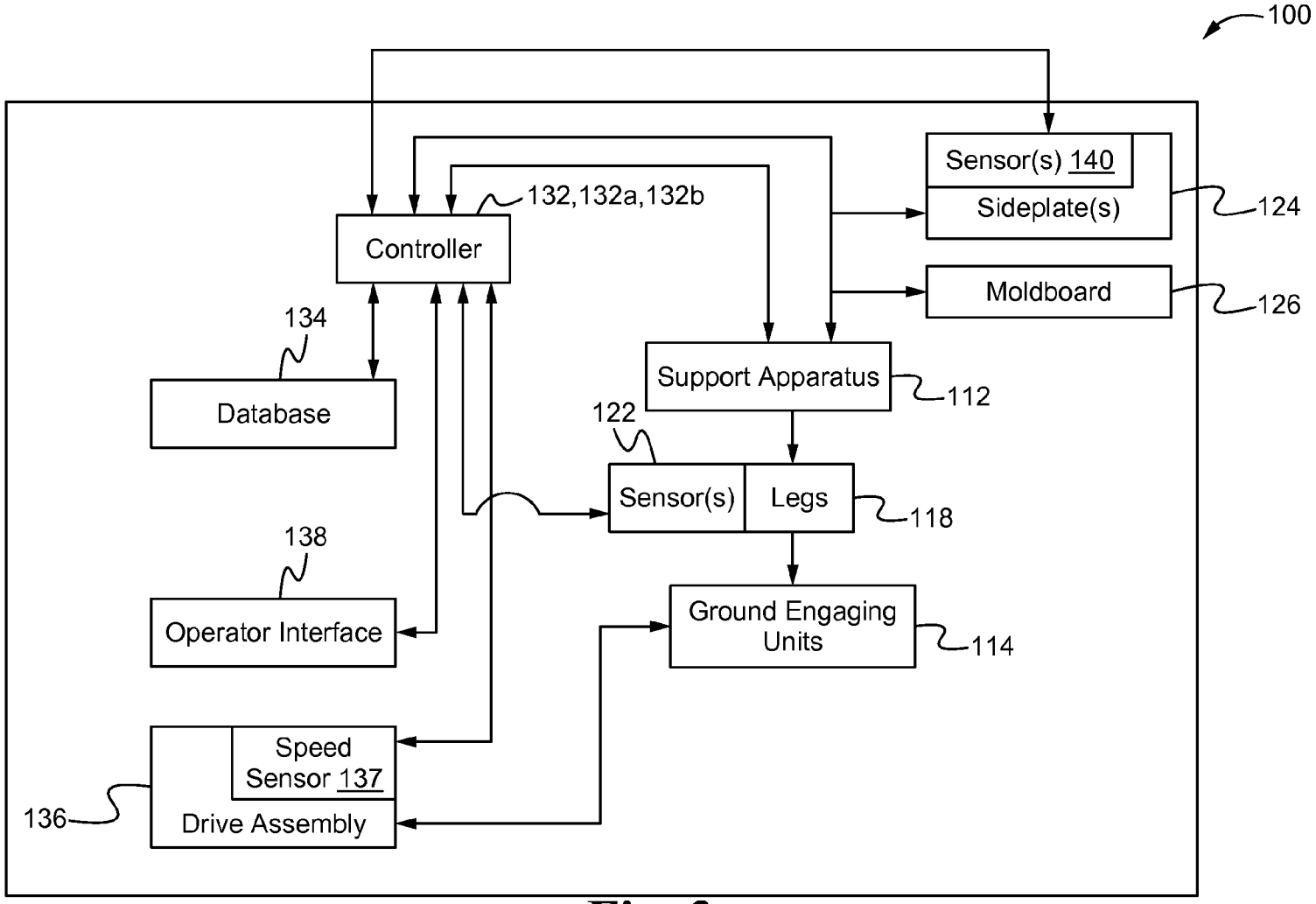
FIG. 3 is a general schematic view of a portion of an exemplary embodiment of machine in accordance with the teachings of this disclosure.

Machines may be configured to perform work operations at job sites. Examples of machines may include cold planers, on and off highway vehicles, construction equipment, and earth-moving equipment. While the teachings of this disclosure are not limited to a particular type of machine, an exemplary machine 100, a cold planer, is shown in FIGS. 1-3 and discussed below to illustrate the teachings of this disclosure.

The exemplary machine 100, a cold planer, may be configured to scarify, remove, mix, or reclaim material from the surface of bituminous, concrete, or asphalt roadways and other surfaces. Elements of the cold planer 100 may include a frame 102, support apparatus 112, a plurality of ground engaging units 114 and a tool 116. The frame 102 may include a front end 104, a rear end 106, a first side 108 and a second side 110. In an embodiment, there may be a plurality of support apparatus 112. Some of the plurality of support apparatus (referred to herein as the "front support apparatus" 112*a*) may be disposed proximal to the front end 104 of the frame 102 and some of the plurality of support apparatus (referred to herein as the "rear support apparatus" 112*b*) may be disposed proximal to the rear end 106 of the cold planer 100. In the embodiment illustrated in FIGS. 1-2 there are two front support apparatus 112*a* disposed on opposite sides of the front end 104 of the frame 102 and two rear support apparatus 112*b* disposed on opposite sides of the rear end 106 of the frame 102.

The support apparatus 112 may be configured to support frame 102 on a surface 120. Each support apparatus 112 may include a leg 118. A leg position sensor 122 may be disposed on, inside, or adjacent to each leg 118. Each leg position sensor 122 may provide to one or more controllers 132 (see FIG. 3) of the cold planer 100 information including, but not limited to, the length L of the leg 118 or the amount of extension or the amount of retraction of the leg 118. In one embodiment, the length L of the leg may be determined by the controller 132 based on a known leg length and the amount of extension or retraction of the leg 118 from that known leg length. Other ways of determining leg length, as known in the art, are also contemplated. Other sensors may be disposed on the frame 102 for sensing other parameters of the machine 100. In the embodiment illustrated in FIGS. 1-2 there are two front legs 118*a*, 118*b* and two rear legs 118*c*, 118*d*. The two front legs 118*a*, 118*b* may be disposed on opposite sides of the front end 104 of the frame 102. The two rear legs 118*c*, 118*d* may be disposed on opposite sides of the rear end 106 of the frame 102.

Ground engaging units 114 may perform the function of transporting the cold planer 100 across a surface 120. Ground engaging units 114 may include tracks, wheels, and/or other known traction devices suitable for use on mobile machines. At least one ground engaging unit 114 may be powered by a machine drive assembly 136 (see FIG. 3) for forward and rearward movement of cold planer 100. An example of a drive assembly 136 may include an internal combustion engine or a hydraulic motor. It is further contemplated that ground engaging units 114 may be coupled to frame 102 by the legs 118.

Legs 118 may be vertically adjustable. As such, the legs 118 may be extended (lengthened) to cause upward movement of the frame 102 with respect to the surface 120 on which the cold planer 100 is disposed and may be retracted (shortened) to cause downward movement of frame 102 with respect to surface 120. In one embodiment, the legs 118 may be columns that include telescoping portions (not shown), such as, for example, overlapping cylindrical segments adapted to slide inward (retract) or outward (extend) with respect to each other. The inward and outward sliding of the overlapping cylindrical segments may raise and lower frame 102, and their movement may be actuated by hydraulic pressure.

Frame 102 may also include one or more structural load carrying members adapted to support and/or protect components of cold planer 100. The frame 102 may include one or more sideplates 124 mounted on the sides of the frame 102. In the exemplary embodiment illustrated in FIGS. 1-2, the frame 102 has two sideplates 124, each moveable in a generally vertical direction between a raised position and a lowered position. In that embodiment, one of the plurality of sideplates 124 is attached to a first side 106 of the frame 102 and the other sideplate 124 is attached to a second side 108 of the frame 102. FIG. 1 illustrates the sideplate 124 on the first side 108 of the frame 102 in the lowered position. FIG. 2 illustrates the other sideplate 124 on the second side 110 of the frame in the raised position. One or more sideplate sensors 140 may be disposed on each sideplate 124. Each sideplate sensor 140 may provide to controllers 132(*a-b*) of the cold planer 100 vertical position information with regard to the sideplates and/or information as to whether the sideplate is in contact with the surface 120.

The frame 102 may also include a moldboard 126 moveable with respect to the rest of the frame 102 in a generally vertical direction between a raised and lowered position. FIG. 1 illustrates the moldboard 126 in a lowered position. FIG. 2 illustrates a moldboard 126 in a raised position.

Other elements of frame 102 may include, for example, housings, beams, and panels. Furthermore, tool 116 may be supported on or within frame 102. In the embodiment illustrated in FIG. 1, the machine 100 also includes a conveyor 128. Tool 116 may include a rotatable planing tool, such as, for example, a rotatable drum 130 or cylinder. Drum 130 may include a plurality of replaceable bits 131 mounted thereon and may be lowered to engage the surface 120. Upon engagement, the bits 131 may cut and remove material from the surface 120. The removed material may enter the conveyor 128 which may transfer the removed material into a dump truck (not shown), or the like, for transport off-site. The height and geometry of the tool 116, in the exemplary embodiment a drum 130, relative to the surface 120 may determine the shape and depth of cut made in the surface 120 and may affect the amount of material removed from the surface 120. Thus, in order to control the shape and depth of a cut in the surface, the grade of the drum 130 may be adjusted such that the drum 130 may be vertically moved away from, towards, or into surface 120 by extending or retracting the legs 118 of the machine 100. The slope of the drum (and the cut that it makes) may also be adjusted by raising or lowering the legs 118 on one side of the machine 100 to a different height than the legs 118 on the opposite side of the machine 100.

A hydraulic system (not shown) may be configured to direct pressurized hydraulic fluid to cause upward or downward movement of legs 118. The hydraulic system may include a hydraulic circuit for selectively supplying the pressurized hydraulic fluid to different areas of hydraulic system and hydraulic cylinders to convert the hydraulic pressure into mechanical motion for actuating legs 118.

As illustrated in FIG. 3, control of the cold planer 100 may be managed by one or more embedded or integrated controller(s) 132 of the cold planer 100. The controller(s) 132 may take the form of one or more processors, microprocessors, microcontrollers, electronic control modules (ECMs), electronic control units (ECUs), or any other suitable means for electronically controlling functionality of the cold planer 100. One or more controllers 132 may be part of subsystem(s), such as the grade and slope system of the machine 100.

The controller(s) 132 may be configured to operate according to a predetermined algorithm or set of instructions for controlling the cold planer 100 based on various operating conditions of the cold planer 100. Such an algorithm or set of instructions may be read into an on-board memory of the controller(s) 132, or preprogrammed onto a storage medium or memory accessible by the controller(s) 132, for example, in the form of a floppy disk, hard drive, optical medium, random access memory (RAM), read-only memory (ROM), or any other suitable computer readable storage medium commonly used in the art (each referred to as a "database"). The controller(s) 132 may be in electrical communication or connected to the drive assembly 136, or the like, and various other components, systems or sub systems (not pictured) of the cold planer 100. The drive assembly 136 may comprises an engine or hydraulic motor among other elements. By way of such connection, a controller 132 may receive data pertaining to the current operating parameters of the cold planer 100 from sensors and the like. In response to such input, the controller 132 may perform various determinations and transmit output signals corresponding to the results of such determinations or corresponding to actions that need to be performed. A speed sensor 137 may be coupled to the motor and may provide data such as measured ground speed to the controllers 132. In response to receipt of the average measured ground speed, the controller 132*a* may use this input to estimate the distance traveled by the machine 100.

The controller(s) 132 may include a plurality of input interfaces for receiving information and command signals from various switches and sensors and other controllers associated with the cold planer 100 and a plurality of output interfaces for sending control signals to various actuators or other controllers 132 associated with the cold planer 100. Suitably programmed controller(s) 132 may serve many additional similar or wholly disparate functions as is well-known in the art.

With regard to input, the controller 132 may receive signals or data from an operator interface 138, leg position sensors 122, speed sensors 137, sideplate sensors 140, other controllers 132, and the like. As can be seen in the exemplary embodiment illustrated in FIG. 3, the first controller 132*a* that may be part of the grade and slope system may receive signals from an operator interface 138 and may exchange signals with a machine controller 132*b*. In an embodiment, the grade and slope system may receive and process data from the operator interface 138 related to the operator desired grade (depth of the cut), the slope of the cut, and the like. The first controller 132*a* and the machine controller 132*b* may also receive position and/or length data from each leg position sensor 122. As noted before, such data may include, but is not limited to, information as to the length L of a leg 118 or the amount of extension or retraction of the leg 118. The controller 132*b* may also receive data from one or more sideplate sensors 140. Such data may include, but is not limited to, information related to the vertical position of the sideplate 124 and/or whether the sideplate 124 is in contact with the surface 120.

The first controller 132*a* may transmit and receive signals to and from the machine controller 132*b*. For example, the first controller 132*a* may transmit to the machine controller 132*b* signals or instructions to increase or decrease the length L of the rear legs 118(*c-d*).

INDUSTRIAL APPLICABILITY

The present disclosure may find applicability in increasing machine productivity by reducing the amount of time it takes the machine operator to maneuver the machine. An operator may desire a machine 100 such as a cold planer to be level for a variety of reasons. Typically in such machines, each leg must be adjusted individually and checked visually or with instruments to achieve a desired extended or retracted level position. The present disclosure finds applicability in maintaining a level condition for the machine 100 quickly and automatically during changes in the grade of the surface 120. This significantly reduces the amount of time and effort required by the operator to achieve the desired level condition.

The machine 100 is considered level in the lengthwise direction when the x-axis of the frame 102 front to rear is parallel with the plane of the surface 120 upon which the machine is disposed. The machine is level in the crosswise direction when the z-axis of the frame (left to right) is parallel with the plane of the surface 120. Unless specified, when the machine is referred to as level it means in both the lengthwise and crosswise direction.

Figure 4:
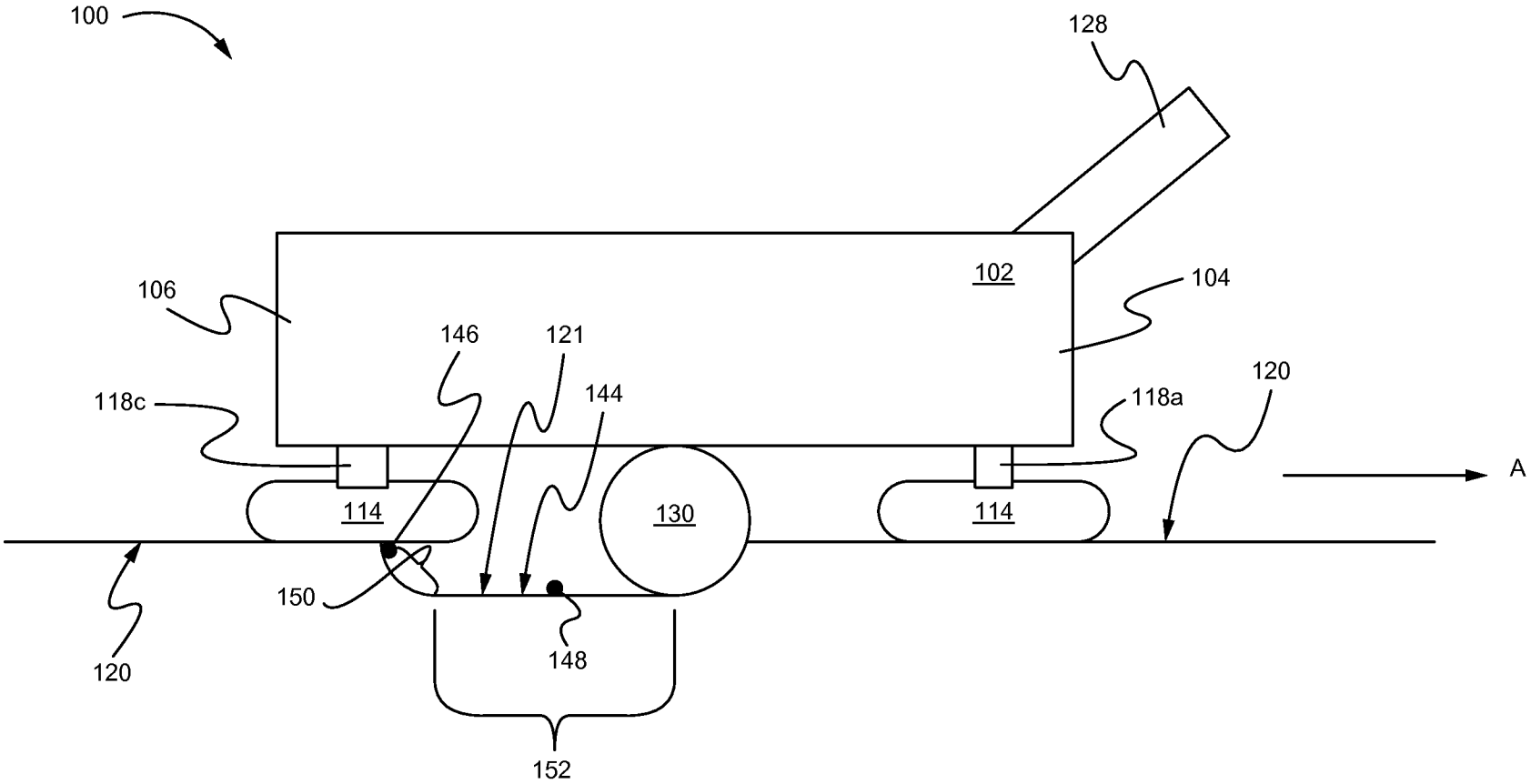
FIG. 4 schematically illustrates one example of leveling a machine on a surface in accordance with the teachings of this disclosure.

FIG. 4 schematically illustrates one example of leveling a cold planer 100 on a surface 120 after the cold planer 100 has made an initial plunge cut into the surface 120 (referred to herein, for clarity, as the first surface 120). In the embodiment illustrated in FIG. 4, the ground engaging units 114 of the cold planer 100 are, prior to the plunge cut, disposed on the first surface 120. During the plunge cut into the first surface 120, cold planer 100 retracts the front and rear legs 118 while maintaining the frame 102 and the drum 130 in a parallel position with the first surface 120. Retraction of the front and rear legs lowers the activated cutting tool 116 into the first surface 120. Scratch is calibrated at the point at which that the drum 130 (including drum bits 131 or the lowest point of a tool 116) touch or scratch the first surface 120. The frame 102 of the cold planer 100 should be parallel to the surface 120 when scratch is calibrated. The term "scratch length" as used herein with regard to a leg 118 means the length of such leg 118 at scratch.

When the drum 130 is activated, rotates and makes cutting contact with a section of the surface 120, material is removed by the drum 130 from that section of the first surface 120. Removal of material from this section of the first surface 120 creates a second surface 121 at a different (and vertically deeper) grade than that of the grade of the first surface 120. Put a different way, the second surface 121 is created by the tool 116 removing the section of the first surface 120. For explanation purposes herein, the first surface will be considered to have a grade of zero. An absolute value will be used for the measurement value of the grade of a surface that is vertically deeper or below the first surface 120. In other words, a second surface 121 that has a grade of two units below the grade of the first surface 120, will have a grade of 2 units, not a grade of negative 2 units as might be expected using the perspective of a conventional four quadrant x-y coordinate axis. As such, a surface (for example a second surface 121) with a deeper (larger) vertical grade (value) than another surface (for example a first surface 120), will be considered herein to have a greater grade than that of the surface lying in a plane above it.

During such the plunge cut, the parallel position of the frame 102 with respect to the first surface may be monitored by the controllers 132. To monitor the parallel position the first controller 132*a* may receive data from the respective position sensors 122 regarding the length (L) of the front and rear legs 118(*a-d*). If the lengths (L) of front and rear legs 118(*a-d*) on the same side (first side 108 or second side 110) of the frame 102 are not substantially the same, the grade and slope system may send a signal to the machine controller 132*b* to adjust the front 118*a*, 118*b* or the rear legs 118*c*, 118*d* in order to maintain the frame 102 parallel with the first surface 120.

After the initial plunge cut is made, the cold planer 100 may move in a forward direction A on the first surface 120. As illustrated in FIG. 4, an initial cut has been made and the cold planer 100 has moved forward in the direction A. The drum 130 continues to rotate and to remove a section of the first surface 120 to create the second surface. Initially both the front and rear legs 118 (*a-d*) move forward in direction A on the first surface 120. However, at some point, the rear legs 118(*c-d*) will begin to descend into the cut and begin to travel over the second surface 121. If no adjustment is made to the length of the rear legs 118(*c-d*), the frame 102 will cease to be substantially parallel with the first surface 120.

The first controller 132*a* is configured to determine the appropriate extension or retraction adjustment to be made to the length of the rear legs 118 (*c-d*) to maintain the frame 102 substantially parallel with respect to the first surface 120 during travel of the rear legs 118 (*c-d*) along the second surface 121.

As illustrated in FIG. 4, a travel path 144 for the rear legs (c-d) may comprise the second surface 121 and may include a first point 146 on the second surface 121 and a second point 148 on the second surface 121. The first point 146 (on the second surface 121) may be directly adjacent to the end of first surface 120.

As can be seen in the exemplary embodiment illustrated in FIG. 4, a first portion 150 of the travel path 144 over the second surface 121 may, in some embodiments, be curved or non-linear in shape and may contain the first point 146 of the travel path 144. In one embodiment, the rear legs 118(*c-d*) may be disposed on the first surface 120 when the first portion 150 of the travel path 144 is created and the frame 102 is maintained substantially parallel to the first surface 120 while the first portion 150 of the travel path 144 is created.

The second portion 152 of the travel path 144 over the second surface 121 may contain the second point 148 and may be substantially linear in shape and lie in a plane that is substantially parallel to the plane of the first surface 120. In the embodiment illustrated in FIG. 4, the second point 148 is the point on the travel path 144 on the second surface 121 at which the length L of each rear leg 118(*c-d*) is substantially the same as the scratch length. For clarity of discussion, the initial surface will be referred to as the first surface 120 having a first grade of zero. The second portion 152 of the travel path 144 on the second surface 121 will have a second grade, the second grade different from the first grade.

Figure 5:
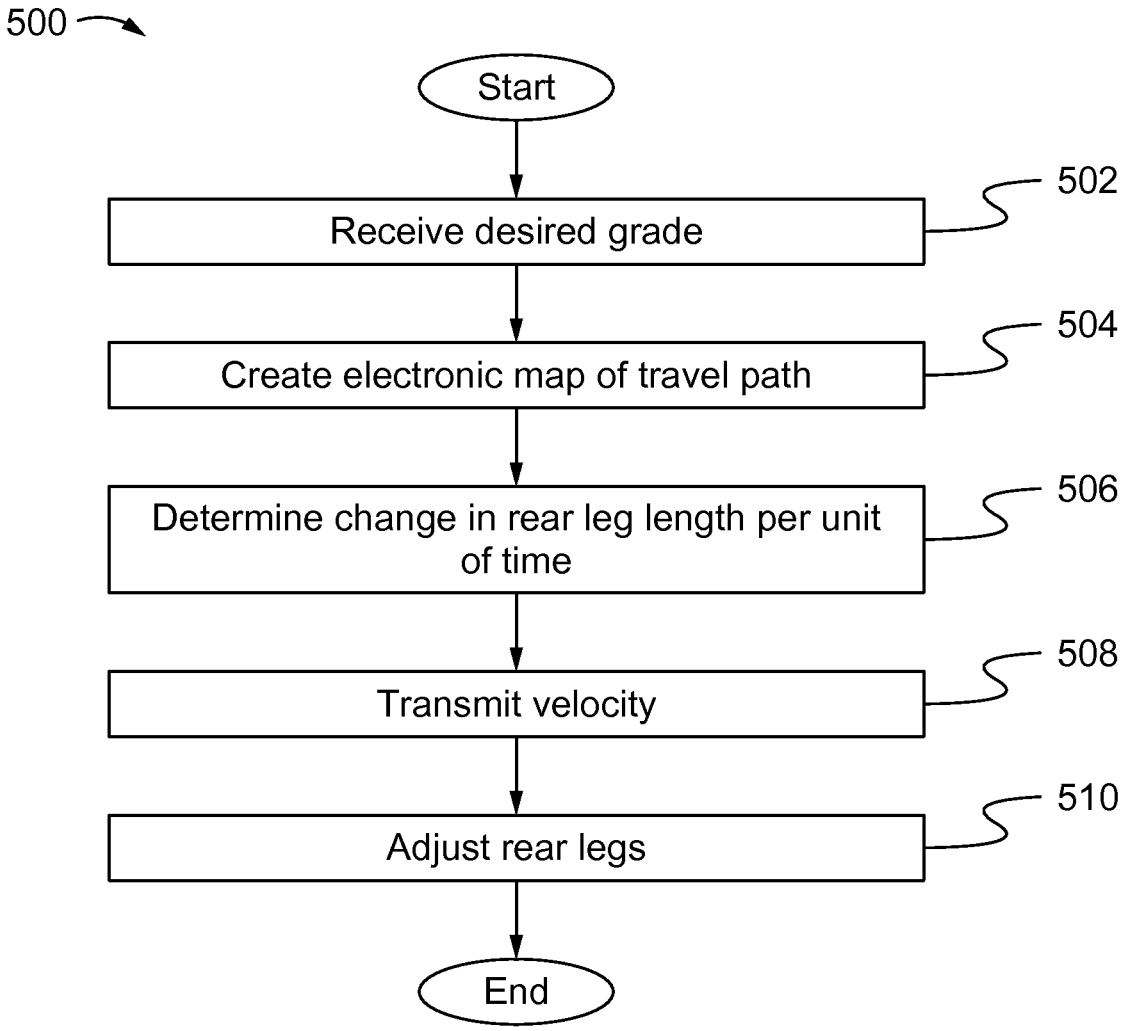
FIG. 5 is a flowchart illustrating exemplary steps of a method of controlling the leveling of a machine in accordance with the present disclosure.

FIG. 5 is an exemplary method 500 for maintaining a machine 100 substantially parallel with a first surface 120 during cutting of the first surface 120 in accordance with an exemplary scenario illustrated in FIG. 4. The method may be practiced with more or less than the number of steps shown and is not limited to the order shown.

In step 502, the first controller 132*a* of the grade and control system may receive from the operator interface 138 the desired grade of the second surface 121. The desired grade may be received from a switch, button or other input mechanism (collectively, a "switch") activated by the operator on the operator interface 138.

In step 504, the first controller 132*a* determines an electronic map of the travel path 144 comprising the second surface 121 between the first point 146 and the second point 148. This electronic map may be created in many ways as known by those of skill in the art. For example, the first controller 132*a* may utilize parameters such as the following to create this map of the travel path 144: the desired grade, the geometric parameters of the tool 116 such as circumference and radius of the drum 130, the length of the ground engaging unit 114, dimensions related to the position and arrangement of the rear leg(s) 118(*c-d*) with respect to the ground engaging unit(s) 114, and the like. The first controller 132*a* may receive at least some of the parameters for the travel path calculation from a database 134 or other memory accessible by the first controller 132*a*.

In step 506, the controller 132*a* determines the change in length L necessary for each rear leg 118(*c-d*) per unit of time as the rear legs 118(*c-d*) travel forward on the travel path 144. The distance traveled by the rear legs 118(*c-d*) may be calculated, as is known how to do in the art, using the average measured ground speed from the motor speed sensor 137 and the elapsed time.

In step 508, the controller 132*a* transmits to the machine controller 132*b* the change in length L necessary for each rear leg 118(*c-d*) per unit of time ("velocity information") as the rear legs 118(*c-d*) travel forward on the travel path 144.

In step 510, the machine controller transmits an activation signal to the rear support apparatus 112*b* to adjust the length L of ear rear leg 118(*c-d*) based on the velocity information provided in step 508. The length of the rear legs 118(*c-d*) is adjusted to maintain the frame 102 substantially level to the first surface 120 as the rear legs 118(*c-d*) move along the travel path 144 from the first point 146 to the second point 148 in the forward direction A. When the rear legs 118(*c-d*) reach the scratch length, the method ends.

In an embodiment, the first controller 132*a* and/or machine controller 132*b* may periodically or continuously receive leg 118 position data from the leg position sensors 122 to monitor the present length of the legs 118 in order to determine whether scratch length has been achieved and to monitor the adjustment of the rear leg length L during the method.

Figure 6:
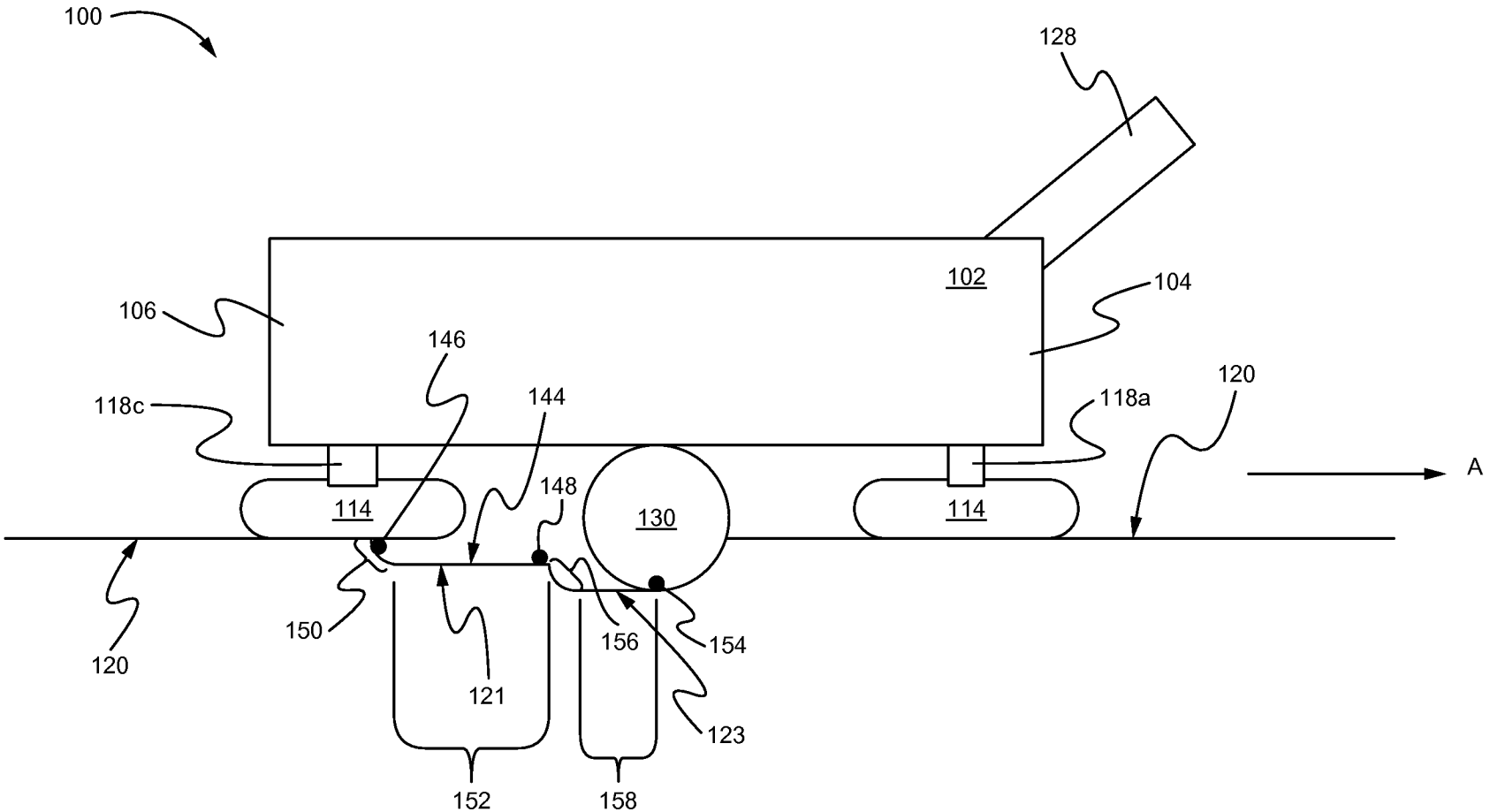
FIG. 6 schematically illustrates another example of leveling a machine on a surface in accordance with the teachings of this disclosure.

In some situations, an operator may make one or more adjustments to the desired grade as illustrated in the exemplary embodiment in FIG. 6. In FIG. 6, the operator selected a grade for the second surface 121 and later selected a different grade. Both the second and third surfaces 121, 123 are created by removing a section of the first surface 120.

As illustrated in FIG. 6, a travel path 144 for the rear legs (c-d) in this scenario may comprise the second surface 121 and the third surface 123. The travel path 144 may include a first point 146 on the second surface 121, a second point 148 on the second surface 121, and a third point 154 on the third surface 123. Similar to the embodiment in FIG. 4, the first point 146 (on the second surface 121) may be directly adjacent to the end of first surface 120. A first portion 150 of the travel path 144 over the second surface 121 may, in some embodiments, be curved or non-linear in shape and may contain the first point 146 of the travel path 144. In one embodiment, the rear legs 118(*c-d*) may be disposed on the first surface 120 when the first portion 150 of the travel path 144 is created and the frame 102 is maintained substantially parallel to the first surface 120 while the first portion 150 of the travel path 144 is created.

The second portion 152 of the travel path 144 over the second surface 121 may contain the second point 148 and may be substantially linear in shape and lie in a plane that is substantially parallel to the plane of the first surface 120. The second portion 152 of the second surface is at the second grade. In the embodiment illustrated in FIG. 6, the second point 148 is the point on the travel path 144 on the second surface 121 at which the length L of each rear leg 118(*c-d*) is substantially the same as the scratch length.

A third portion 156 of the travel path 144 may be on the third surface 123 and may, in some embodiments, be curved or non-linear in shape. A fourth portion 158 of the travel path 144 may also be on the third surface 123 and may be substantially linear and may lie in a plane that is substantially parallel to the plane of the first surface 120. The fourth portion 158 may contain the third point 154 which is the point on the third surface 123 at which the length L of the rear legs 118 will reach scratch length. For clarity of discussion, the initial surface will be referred to as the first surface 120 having a first grade of zero. The second portion 152 of the travel path 144 on the second surface 121 will have a second grade and the fourth portion 158 of the travel path 144 on the third surface 123 will have a third grade, the third grade different from the second grade.

Similar to the scenario discussed above with respect to FIG. 4, the controller 132*a* is configured to maintain the frame 102 parallel with the first surface along the entire travel path 144. However, the travel path 144 now includes a first point 146 and a second point 148 on the second surface 121, as described previously, and the third point 154 on the third surface 123.

Figure 7:
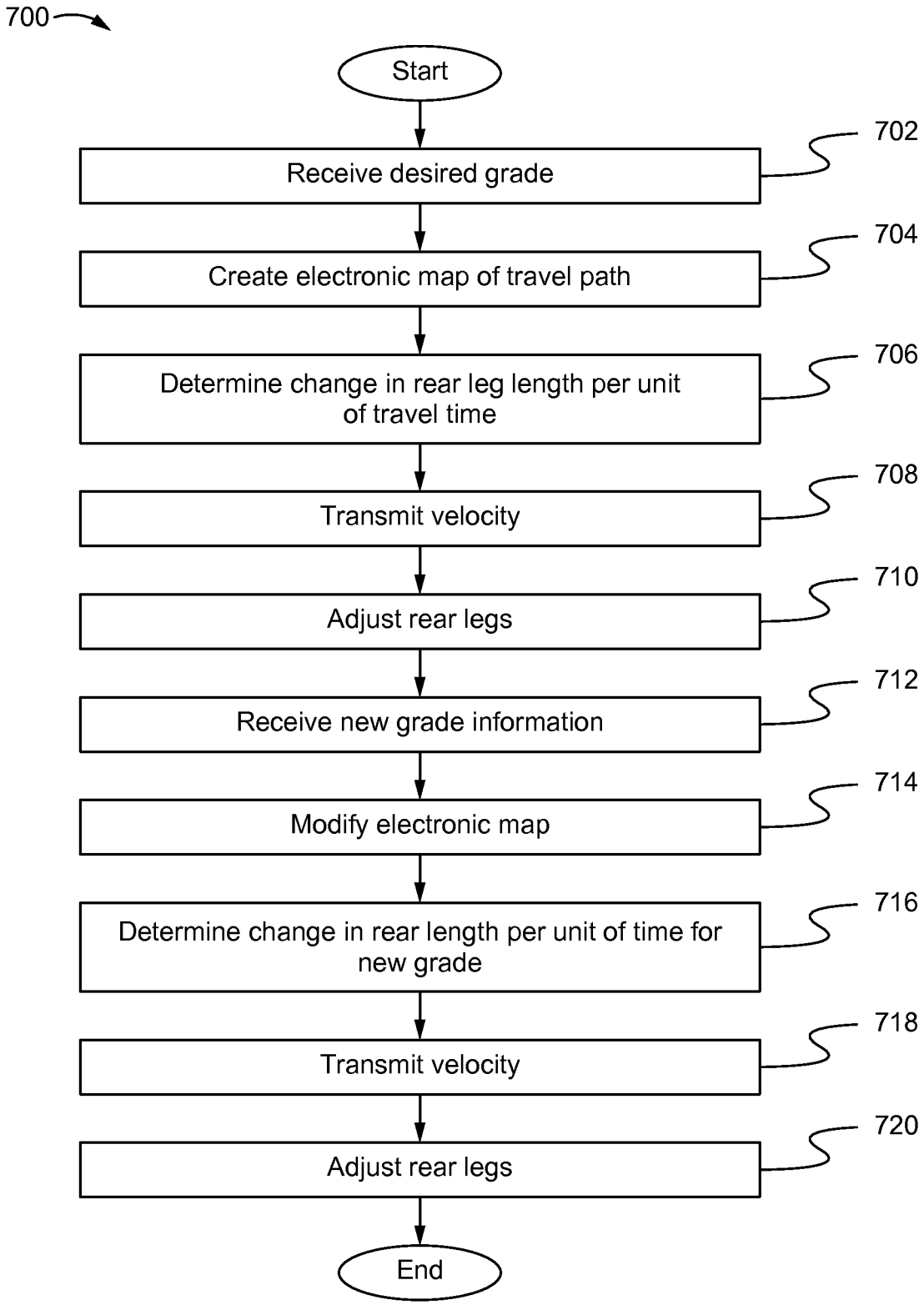
FIG. 7 is a flowchart illustrating exemplary steps of a method of controlling the leveling of a machine in accordance with the present disclosure.

FIG. 7 illustrates an exemplary method 700 for controlling the leveling of a machine 100 on a travel path 144 in accordance with the exemplary embodiment illustrated in FIG. 6. The method may be practiced with more or less than the number of steps shown and is not limited to the order shown. Travel paths 144 having more than two grades are also contemplated and the method may be modified to accommodate an unlimited plurality of grades on a travel path 144.

Similar to step 502 in FIG. 5, in step 702, the first controller 132*a* of the grade and control system may receive from the operator interface 138 the desired grade of the second surface 121.

Similar to step 504 in FIG. 5, in step 704, the first controller 132*a* determines an electronic map of the travel path 144 on the second surface 121 between the first point 146 and the second point 148.

Similar to step 506 in FIG. 5, in step 706, the controller 132*a* determines the change in length L necessary for each rear leg 118(*c-d*) per unit of time as the rear legs 118(*c-d*) travel forward in a direction A on the travel path 144. The distance traveled by the rear legs 118(*c-d*) may be calculated, as is known how to do in the art, using the average measured ground speed from the motor speed sensor 137 and the elapsed time.

Similar to step 508 in FIG. 5, in step 708, the controller 132*a* transmits to the machine controller 132*b* the change in length L necessary for each rear leg per (118*c-d*) unit of time (velocity information) as the rear legs 118(*c-d*) travel forward on the travel path 144.

In step 710, the machine controller 132*b* transmits an activation signal to the rear support apparatus 112*b* to adjust the length L of ear rear leg 118(*c-d*) based on the velocity information provided in step 708.

In step 712, the first controller 132*a* may receive from the operator interface 138 the desired grade of the third surface 123. This new grade information may result in the controller 132*a* sending a signal to the machine controller 132*b* to adjust the L of the rear legs (*c-d*) and the front legs 118(*a-b*) for the new grade. In other embodiments, the first controller 132*a* may control the necessary adjustment in length L of the front legs 118(*a-b*) for the new grade and may send a signal to the machine controller 132*b* to adjust the L of the rear legs for the new grade. The frame 102 is maintained in a parallel orientation with regard to the first surface 120 during the adjustment of the front and rear legs 118(*a-d*) during the change in grade.

In step 714 the first controller 132*a* may modify the electronic map of the travel path 144 to now include the third surface 123 and the third point 154 at the new desired grade. This electronic map may be created/modified in many ways as known by those of skill in the art. For example, the first controller 132*a* may utilize parameters such as the following to create/modify this map of the travel path 144: the desired grades, the geometric parameters of the tool 116 such as circumference and radius of the drum 130, the length of the ground engaging unit 114, dimensions related to the position and arrangement of the rear leg(s) 118(*c-d*) with respect to the ground engaging unit(s) 114, the distance already traveled by the rear legs 118(*c-d*) and the tool 116 on the second surface 121, and the like. The first controller 132*a* may receive at least some of the parameters for the travel path calculation from a database 134 or other memory accessible by the first controller 132*a*.

In step 716, the first controller 132*a* determines the change in length L necessary for each rear leg per 118(*c-d*) unit of time as the rear legs 118(*c-d*) travel forward on the travel path 144 (the second and third surface). The distance traveled by the rear legs 118(*c-d*) may be calculated, as is known how to do in the art, using the average measured ground speed from the motor speed sensor 137 and the elapsed time.

In step 718, the controller 132*a* transmits to the machine controller 132*b* the change in length L necessary for each rear leg 118(*c-d*) per unit of time (velocity information) as the rear legs 118(*c-d*) travel forward on the travel path 144.

In step 720, the machine controller 132*b* transmits an activation signal(s) to the rear support apparatus 112*b* to adjust the length L of each rear leg 118(*c-d*) based on the velocity information provided in step 718. When the length L of the rear legs 118(*c-d*) reach the scratch length, the method ends.

In an embodiment, the first controller 132*a* may periodically or continuously receive rear leg position information from the leg position sensors 122 to determine the present length of the legs 118 in order to determine whether scratch length has been achieved and to monitor the adjustment of the rear leg length during the method.

Figure 8:
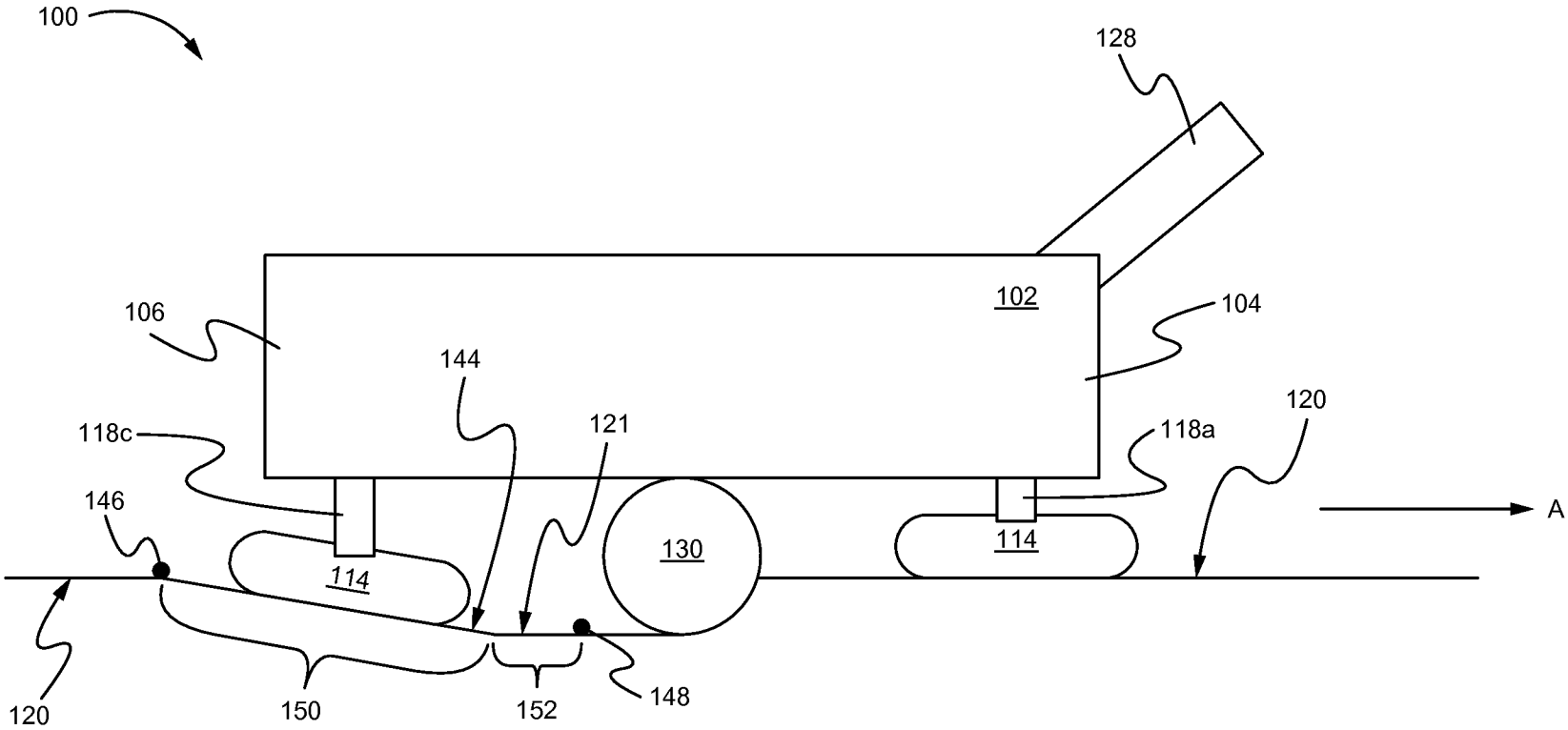
FIG. 8 illustrates another example of leveling a machine on a surface in accordance with the teachings of this disclosure.

FIG. 8 illustrates another exemplary application of the present disclosure when the cold planer 100 makes a gradual cut into the work surface 120 to a specified grade by lowering the frame 102 of the cold planer 100 and the tool 116 as the cold planer 100 travels in the forward direction A. In FIG. 8, the front legs 118(*a-b*) of the cold planer 100 are disposed on the work surface 120. The rear legs 118(*c-d*) travel along the second surface 121.

During such a gradual cut, the parallel position of the frame 102 with respect to the first surface 120 may be monitored. To monitor the parallel position the first controller 135*a* and the machine controller 132*b* may receive data from the front and rear leg position sensors 122 related to the length L of the front 118(*a-b*) and rear legs 118(*c-d*).

During the gradual cut, the cold planer 100 moves in a forward direction A. The drum 116 rotates and removes a section of the first surface 120 to create the second surface 121. The first controller 132*a* is configured to determine the appropriate extension or retraction adjustment to be made to the length L of the rear legs 118(*c-d*) to maintain the frame 102 parallel with respect to the first surface 120 during travel of the rear legs 118(*c-d*) along the second surface 121.

As illustrated in FIG. 8, the travel path 144 for the rear legs (c-d) may comprise the second surface 121 and may include a first point 146 on the second surface 121 and a second point 148 on the second surface 121. The first point 146 (on the second surface 121) may be directly adjacent to the end of first surface 120.

As can be seen in the exemplary embodiment illustrated in FIG. 8, a first portion 150 of the travel path 144 over the second surface 121 may have a generally linear slope and may contain the first point 146 of the travel path 144. The second portion 152 of the travel path 144 over the second surface 121 may contain the second point 148 and may be substantially linear in shape and lie in a plane that is substantially parallel to the plane of the first surface 120. For clarity of discussion, the initial surface will be referred to as the first surface 120 having a first grade of zero. The second portion 152 of the travel path 144 on the second surface 121 will have a second grade, the second grade different from the first grade. The first portion 150 of the travel path on the second surface 121 will have a changing grade as the cut depth is gradually adjusted from the grade of the first surface 120 to the grade of the second portion 152 of the second surface 121. In the embodiment illustrated in FIG. 8, the second point 148 is the point on the travel path 144 on the second surface 121 at which the length L of each rear leg 118(*c-d*) is substantially the same as the scratch length.

Figure 9:
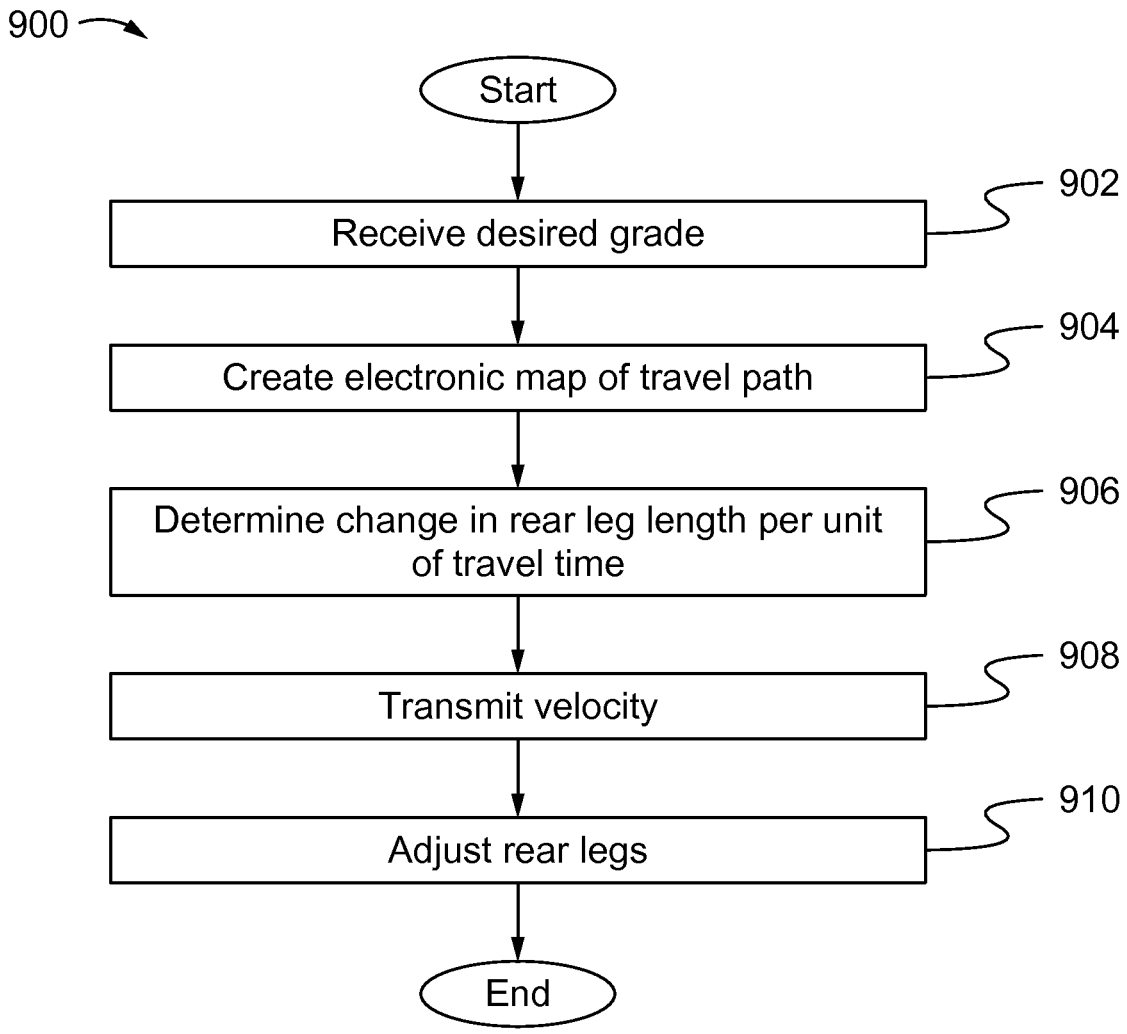
FIG. 9 is a flowchart illustrating exemplary steps of a method of controlling the leveling a machine in accordance with the present disclosure.

FIG. 9 is an exemplary method 900 for controlling the leveling of a machine 100 with respect to a first surface 120 during cutting in accordance with an exemplary illustrated in FIG. 8. The method may be practiced with more or less than the number of steps shown and is not limited to the order shown.

In step 902, the first controller 132*a* may receive from the operator interface 138 the desired final grade of the second surface 121 and the desired distance that the cold planer 100 should travel (the first portion 150 of the second surface 121) to ease into (or out of) a cut to reach the new grade. The desired grade may be received from a switch, button or other input mechanism (collectively, a "switch") activated by the operator on the operator interface 138.

Similar to step 504 in FIG. 5, in step 904, the first controller 132*a* determines an electronic map of the travel path 144 on the second surface 121 between the first point 146 and the second point 148. This map may be created in many ways as known to those of skill in the art. For example, the first controller may utilize the following parameters to create this map of the travel path: the desired grade, the travel distance to ease into (or out of) the cut until the desired grade is achieved, the geometric parameters of the tool such as circumference and radius of the drum, the length of the ground engaging unit, dimensions related to the position and arrangement of the rear leg with respect to the ground engaging unit, and the like. The first controller 132*a* may receive at least some of the parameters for the travel path calculation from the operator interface 138, and a database 134 or other memory accessible by the first controller 132*s*.

In step 906, the controller 132*a* determines the change in length L necessary for each rear leg 118(*c-d*) per unit of travel time as the rear legs (118*c-d*) travel forward on the travel path 144. The distance traveled by the rear legs 118(*c-d*) may be calculated, as is known how to do in the art, using the average measured ground speed from the motor speed sensor 137 and the elapsed time.

In step 908, the first controller 132*a* transmits to the machine controller 132*b* the change in length L necessary for each rear leg 118(*c-d*) per unit of travel time ("velocity information") as the rear legs 118(*c-d*) travel forward on the travel path 144.

In step 910, the machine controller transmits an activation signal to the rear support apparatus 112*b* to adjust the length L of the rear legs 118(*c-d*) based on the velocity information provided in step 908. When, the length L of the rear legs 118(*c-d*) reach the scratch length, the method ends.

In an embodiment, the first controller 132*a* may periodically or continuously receive rear leg position data from the leg position sensors 122 to determine the present length L of the legs 118(*c-d*) in order to determine whether scratch length has been achieved and to monitor the adjustment of the rear leg length L during the method.

The features disclosed herein may be particularly beneficial to cold planers and other vehicles that maintain the frame of a machine or vehicle parallel to a work surface while adjusting the grade of the surface.

What is claimed is:

1. A method of maintaining a machine substantially level with a first surface as the machine traverses a second surface cut from the first surface, the machine including a front leg and a rear leg, a frame supported by the front leg and the rear leg, and a tool mounted on the frame between the front and rear legs, the front leg disposed on the first surface, the method comprising:

determining a desired grade of the second surface;

determining an electronic travel path based on the desired grade of the second surface, the electronic travel path including a first point corresponding to a beginning of the second surface and a second point corresponding to a subsequent portion of the second surface;

determining a desired length change of the rear leg based on the electronic travel path, the desired length change of the rear leg being selected to maintain the frame substantially level to the first surface from the first point to the second point of the electronic travel path;

advancing the machine with the tool operative to create the second surface;

determining when the rear leg reaches the first point of the electronic travel path; and adjusting an actual length of the rear leg based on the desired length change of the rear leg as the as the rear leg traverses the electronic travel path from the first point to the second point.

2. The method of claim 1, further comprising:

activating the tool; and creating a first portion of the second surface by retracting the front and rear legs to lower the activated tool into the first surface.

3. The method of claim 2, wherein the rear leg is disposed on the first surface when the first portion of the second surface is created, the method further comprising maintaining the frame substantially parallel to the first surface while creating the first portion of the second surface.

4. The method of claim 3, further comprising:

receiving data from a rear leg sensor mounted on the rear leg; and monitoring the length of the rear leg based on the data received.

5. The method of claim 1, wherein the first point of the electronic travel path corresponds to a point on the second surface that is disposed directly adjacent to the first surface, and a length of the rear leg at the second point is substantially the same as a scratch length of the rear leg.

6. The method of claim 1, wherein the electronic travel path includes a non-linear first portion, and a second portion oriented generally parallel to the first surface.

7. The method of claim 1, wherein the electronic travel path includes a first portion having a generally linear slope.

8. The method of claim 7, wherein the electronic travel path includes a second portion adjacent and subsequent to the first portion, the second portion oriented generally parallel to a plane of the first surface.

9. A method of maintaining a cold planer substantially level to a first surface as the machine traverses a second surface and a third surface cut from the first surface, the cold planer including a front leg having a front leg length and a rear leg having a rear leg length, a frame supported by the front and rear legs, and a rotatable drum mounted on the frame between the front and rear legs, the front leg disposed on a first surface having a first grade, the method comprising:

determining a desired second grade of the second surface;

determining a desired third grade of the third surface;

determining an electronic travel path based on the desired grade of the second surface and the desired grade of the third surface, the electronic travel path including a first point corresponding to a beginning of the second surface, a second point corresponding to a subsequent portion of the second surface, and a third point subsequent to the second point and corresponding to a portion of the third surface, the second point on the second surface at the desired second grade and the third point on the third surface at the desired third grade, wherein the first grade, the desired second grade, and the desired third grade are different and the first point is disposed directly adjacent to the first surface;

determining a desired length change of the rear leg based on the electronic travel path, the desired length change of the rear leg being selected to maintain the frame substantially level to the first surface from the first point to the third point of the electronic travel path;

advancing the machine with the tool operative to create the second and third surfaces;

determining when the rear leg reaches the first point of the electronic travel path;

adjusting an actual length of the rear leg based on the desired length change of the rear leg as the rear leg traverses the electronic travel path from the first point to the second point;

determining when the rear leg reaches the second point of the electronic travel path; and adjusting the actual length of the rear leg based on the desired length change of the rear leg as the rear leg traverses the electronic travel path from the second point to the third point.

10. The method of claim 9, further comprising:

receiving by a controller a first signal to lower the drum into the first surface to create the second surface by retracting the front and rear legs;

moving the cold planer in a forward direction on the first surface;

receiving by a controller a second signal to lower the drum further to create the third surface.

11. The method of claim 9, wherein the electronic travel path includes a non-linear portion and a parallel portion oriented generally parallel to the first surface.

12. The method of claim 9, wherein the rear leg length at the third point is substantially the same as a scratch length of the rear leg.

13. The method of claim 9, wherein the second surface includes a portion oriented generally parallel to the first surface, and the third surface includes another portion oriented generally parallel to the first surface.

14. A machine for planing a road defining a first surface to form a second surface different from the first surface, the machine comprising:

a frame;

a plurality of ground engaging units, a plurality of vertically adjustable legs, each leg connecting one of the plurality of ground engaging units to the frame, the plurality of legs including at least one rear leg having a rear leg length and at least one front leg having a front leg length, the front leg disposed on the first surface; and a controller operably coupled to the ground engaging units and the plurality of vertically adjustable legs and configured to:

determine a desired grade of the second surface;

determine an electronic travel path based on the desired grade of the second surface, the electronic travel path including a first point corresponding to a beginning of the second surface and a second point corresponding to a subsequent portion of the second surface;

determine a desired length change of the rear leg based on the electronic travel path, the desired length change of the rear leg being selected to maintain the frame substantially level to the first surface from the first point to the second point of the electronic travel path;

advance the machine with the tool operative to create the second surface;

determine when the rear leg reaches the first point of the electronic travel path; and adjust an actual length of the rear leg based on the desired length change of the rear leg as the rear leg traverses the electronic travel path from the first point to the second point.

15. The machine of claim 14, wherein a portion of the electronic travel path is non-linear.

16. The machine of claim 14, wherein a portion of the electronic travel path has a substantially linear slope.

17. The machine of claim 14, further comprising a rotatable drum mounted to the frame and configured to remove a portion of the first surface to create the second surface, the drum disposed between the front leg and the rear leg.

18. The machine of claim 14, in which a third surface is also cut from the first surface of the road, wherein at least a part of the third surface is disposed at a third grade, the third grade different than the first and second grades.

19. The machine of claim 18, wherein the rear leg length is substantially the same as the scratch length of the rear leg when the rear leg moves along the part of the third surface disposed at the third grade.

20. The method of claim 1, in which determining when the rear leg reaches the first point of the electronic travel path comprises determining an average machine velocity and an elapsed time.

* * * * *